US009816674B2

(12) United States Patent
Elmvang

(10) Patent No.: US 9,816,674 B2
(45) Date of Patent: Nov. 14, 2017

(54) LIGHTING DEVICE, INSERTION AND RECEIVING ELEMENT

(71) Applicant: Fischer Lighting ApS, Vanløse (DK)

(72) Inventor: Stig Elmvang, Skovlunde (DK)

(73) Assignee: FISCHER LIGHTING APS, Vanlose (DK)

( * ) Notice: Subject to any disclaimer, the term of this patent is extended or adjusted under 35 U.S.C. 154(b) by 0 days.

(21) Appl. No.: 14/432,533

(22) PCT Filed: Oct. 4, 2013

(86) PCT No.: PCT/DK2013/050315
§ 371 (c)(1),
(2) Date: Mar. 31, 2015

(87) PCT Pub. No.: WO2014/053145
PCT Pub. Date: Apr. 10, 2014

(65) Prior Publication Data

US 2015/0292692 A1 Oct. 15, 2015

Related U.S. Application Data

(60) Provisional application No. 61/711,411, filed on Oct. 9, 2012.

(30) Foreign Application Priority Data

Oct. 5, 2012 (DK) ..... PA 2012 70610

(51) Int. Cl.
*F21S 2/00* (2016.01)
*F21S 8/02* (2006.01)
(Continued)

(52) U.S. Cl.
CPC ..... *F21S 2/005* (2013.01); *F21S 8/026* (2013.01); *F21V 7/0066* (2013.01); *F21V 7/22* (2013.01);
(Continued)

(58) Field of Classification Search
CPC ..... F21S 2/005; F21V 7/22; F21V 7/0066
See application file for complete search history.

(56) References Cited

U.S. PATENT DOCUMENTS 5,045,978 A 9/1991 Gargle
6,435,691 B1 8/2002 Macey et al.
(Continued)

FOREIGN PATENT DOCUMENTS

CN 201045479 Y 4/2008
DE 102010054677 A1 6/2012
(Continued)

OTHER PUBLICATIONS

International Search Report and Written Opinion for PCT/DK2013/050315, dated Feb. 24, 2014.

*Primary Examiner* — Elmito Breval
(74) *Attorney, Agent, or Firm* — Dinsmore & Shohl LLP

(57) ABSTRACT

The present application relates to a lighting device (1) comprising a main body (2) having an inner surface (3) and an outer surface (4). The inner surface (3) at least in part forming a section (12) for receiving a light source. The outer surface (4) having a first thread (8) along at least part of said outer surface (4), wherein said first thread (8) is for directly or indirectly securing the lighting device (1) in a building part. The invention further relates to a receiving element (17) and an insertion (29) for use with the lighting device (1).

19 Claims, 23 Drawing Sheets

(51) Int. Cl.

| | |
|---|---|
| ***F21V 17/12*** | (2006.01) |
| ***F21V 19/00*** | (2006.01) |
| ***F21V 19/02*** | (2006.01) |
| ***F21V 21/04*** | (2006.01) |
| ***F21V 23/00*** | (2015.01) |
| ***F21V 29/77*** | (2015.01) |
| ***F21V 7/22*** | (2006.01) |
| *F21V 7/00* | (2006.01) |
| *F21Y 115/10* | (2016.01) |

(52) U.S. Cl.

CPC ..... *F21V 17/12* (2013.01); *F21V 19/0055* (2013.01); *F21V 19/02* (2013.01); *F21V 21/043* (2013.01); *F21V 23/008* (2013.01); *F21V 29/773* (2015.01); *F21V 7/00* (2013.01); *F21Y 2115/10* (2016.08)

(56) References Cited

U.S. PATENT DOCUMENTS

| | | | |
|---|---|---|---|
| 2005/0036321 | A1 | 2/2005 | Ward |
| 2005/0111222 | A1 | 5/2005 | Olsson et al. |
| 2009/0116251 | A1 | 5/2009 | Harbers et al. |
| 2013/0021784 | A1 | 1/2013 | Jang et al. |

FOREIGN PATENT DOCUMENTS

| | | | |
|---|---|---|---|
| KR | 101033977 | B1 | 5/2011 |
| WO | 2011122827 | A2 | 10/2011 |

LIGHTING DEVICE, INSERTION AND RECEIVING ELEMENT

CROSS-REFERENCE TO RELATED APPLICATIONS

This application is the U.S. National Phase of PCT/DK2013/050315 filed Oct. 4, 2013, which claims priority of Danish Patent Application PA 2012 70610 filed Oct. 5, 2012, and U.S. Provisional Patent Application 61/711,411 filed Oct. 9, 2012.

FIELD OF INVENTION

The invention relates to a lighting device, in particularly a modular lighting device.

BACKGROUND OF THE INVENTION

Different systems for mounting armatures in e.g. sealing's exists, however these systems all have disadvantages. Some of these disadvantages may be that the armatures can only be mounted from above the sealing or that the method of mounting armature itself and a bulb in the armature can be very challenging.

Further as new and more energy optimized light sources are introduced to the market old systems may become obsolete leaving the owner faced with a need to change existing armatures—which in e.g. in the case of light sources and armatures in larger hotels may be a significant expense as well as it from an environmental point of view is highly undesirable.

Thus, there is a need for armatures which may be mounted in sealing's from below and which in general may be easier to handle and provide a simplified method of mounting the bulb. Further there is a need for systems and methods enabling reuse and/or refitting of existing armatures to receive new light sources.

SUMMARY OF THE INVENTION

According to a first aspect of the present invention is provided a lighting device enabling an improved method of mounting, in particularly mounting into existing building structures, more particularly to be mounted into the holes in the building structures when replacing old-fashioned lighting devices.

In a second aspect of the present invention is provided a lighting device which can be used on its own as-is or as a part for refitting existing armatures.

In a third aspect of the present invention is provided a lighting device which prevents entanglement of views for a light source during mounting.

These and other advantages are achieved by a modular lighting device comprising: a main body having a section for receiving a light source and an outer surface, wherein the outer surface has a first thread along at least part of said outer surface for securing the lighting device in a building part through a receiving element, and a receiving element for receiving said main body, said receiving element having a threaded receiving part corresponding to the first thread of the main body.

I.e. the lighting device comprises a first thread which enables that the lighting device may be screwed into the receiving element which is insertable into a building structure. Thus by the present invention is provided a lighting device which is insertable into building structures by a simple process which is in contrast to the known methods including mounting via spring forced clips and the like which can be challenging to work with.

The inner surface of the lighting device at least in part is arranged to receive a light source such as a LED bulb or other known light sources. Depending on for example the size of the lighting device and the intended use of the lighting device the inner surface e.g. provides a section which is only large enough to contain a light source and wherein this section constitutes all of or close to all of the lighting device. It is also possible that the light source extends out of the lighting device and is only partly contained in said lighting device.

The lighting device also comprises a first open end through which e.g. the part of the light source ensuring electric connection is extending, and a second open part through which the light from the lighting device is shining.

In several embodiments the main body is a cylindrical element whereby the lighting device may have the shape of a small or large cylinder wherein the inner cylinder surface may be the inner surface and the outer cylinder surface may be the outer surface. A cylinder shape or a partly cylinder shape may provide a versatile lighting device.

In another embodiment the main body comprises a plurality of fins extending radially, such as extending radially from a central cylinder. In this embodiment the first thread is provided at the outer surface of the fins as shown in the figures. The main body in this embodiment thereby serves an additional purpose as being able to function as a cooling element for the light source.

The first thread may extend along a majority of the outer surface which for example can be advantageous where the lighting device is for example a cylinder shape with a height similar to the thickness of the building parts wherein it is to be secured. Also a relatively broad threaded section can be used to ensure a good grip between e.g. lighting device and building structures and may be used with or without a reinforcement of the backside of the building structure. For example if the lighting device is mounted in a relatively thin loft panel an extra plate or reinforcement can be added to the loft panel so that the first thread engage both loft plate and reinforcement. Such a reinforcement can advantageously in some embodiments be a large plate-like nut receiving the first thread and distributing the force over a larger area than a small nut would.

Thus in some situations it is preferred that the first thread extends over substantially the entire outer surface. In other embodiments the first thread can also extend over several areas if the first thread needs to engage in different plates, structures or the like.

Alternatively the thread may extend over only a minor section of the outer surface. For example a large lighting device may have a thread along a one or more sections of the outer surface enabling the lighting device to be inserted into e.g. a panel in a sealing. Depending on how the lighting device is supposed to be arranged—if the lighting source is to be countersunk or protruding from the building structure—the thread can be arranged along a section near an end part of the lighting or in a more central region of the outer surface of the lighting device.

It is also possible that a basic lighting device e.g. in the form of a mainly cylindrical armature according to the present invention can be used as-is for directly for receiving a light source or can be used to refit existing armatures to enable the use of e.g. LED light bulbs instead of outdated light sources.

If the inner surface comprises means for fastening the light source the known methods for fastening the light source such as a halogen bulb in a sealing armature by means of spring retainer can be avoided. These means for fastening may e.g. be different type of locks or spring loaded ball locks.

In some preferred embodiments the inner surface comprises at least one second thread allowing engagement of various insertion elements with the inner surface. This second thread can cover the full inner surface or one or more sections of the inner surface.

If the first thread is self-trapping the lighting device may be screwed into different building elements such as a sealing panel without any pre-cut thread in said building element.

In several embodiments the inner surface at least in part forms a reflector i.e. part of the inner surface forms a section for receiving the light source and another part of the inner surface forms a reflector. When the inner surface forms a reflector specific types of lighting devices can be achieved such as lighting device providing an indirect light and/or a light cone with an increased angle. Reflector type lighting devices may thus be used to increase both comfort and practical issues.

In another embodiment the modular lighting device comprises a reflector comprising a thread for connecting the reflector to the main body, wherein the reflector comprises a thread engageable with either the first or the second thread of the main body. The reflector may have any suitable shape as discussed below.

Furthermore, it is preferred that the control units, cables and/or connectors are attached directly or indirectly to the main body to facilitate a simple and fast installation of the light device. Accordingly, in one embodiment the lighting device also comprises an attachment means for attaching a control unit, cable and/or a connector to the main body.

In one embodiment the lighting device comprises attachment means for attaching a control unit etc. for the light source where said attachment means enables rotation of the control unit relatively to the main body of the lighting device it can be possible to insert the lighting device into e.g. e sealing or wall panel without entanglement or twisting of the wires. Especially when the lighting device is inserted through of the first tread which requires rotation of the lighting device it is advantageous that the lighting device can rotate relatively to e.g. a control unit and/or wires and cables thereby avoiding that connections, wires, cables etc. gets twisted and/or entangled.

For example the attachment means comprises a first part in form of a circumferential recess in the outer surface of the main body which recess can receive a part of the control means or a holder attached to e.g. the control means. If the part or holder etc is received in the circumferential recess in a way which allows the part, holder etc. to slide along the recess the lighting device can be rotated while whatever is attached to it is unaffected by the movement of the lighting device thereby avoiding that cables etc. becomes twisted.

The attachment means can comprise a second part in form of a clip for movably engaging said first attachment means allowing a control unit or other devices to be movably attached to the lighting device. The clips can have the shape of an open circular structure which can be made to encircle at least a part of the main body of the lighting device.

In another embodiment the attachment means may be a plate capable of being attached to the main body either fixed or rotatably, such as a plate having a hole being adapted to fit over the main body. A connector may be attached to the plate for example by being screwed onto the plate.

In a preferred embodiment, the main body may comprises a slit extending from the first end of the main body, the slit having a size allowing a cable powering the light source to pass through. Thereby, the cable is in a fix position in relation to the main body. Preferably the slit extends more than half way down the main body, Thus a lighting device according to the present invention can have numerous shapes based on the modules engaged with the at least one first thread on the outer surface, which enable the fitting of the lighting device into a building element.

In some embodiments the lighting device is basically a simple cylinder for containing a light source, which cylinder for example can have a circumferential shoulder or cover plate if desired. The inner diameter of the cylinder depends on the light source which it is intended to receive and thus can e.g. be 5, 10, 15, 20 cm. If this type of lighting device is arranged to be inserted into a loft or wall panel the height of the cylinder may advantageously be 1.5-8 cm in order to reach through the hole in the building element if it is required that a nut is used to fasten the lighting device.

In other embodiments the lighting device is of a reflector type comprising a receiving section in form of a basically a simple cylinder for containing a light source. The inner diameter of the cylinder depends on the light source which it is intended to receive and thus can e.g. be 5, 10, 15 or 20 cm. The reflector part is often some type of cone either simple or e.g. with a shoulder. The diameter of the second opening of a reflector type lighting device according to the present invention preferably depends on the diameter of the light source and/or of the diameter of the receiving part. Thus, the reflector may provide for any shape of the emitted light from a diffuse light cone to a very focused light spot. For example the diameter of the second opening can be 7, 10, 15, 20, 25 or 30 cm.

The height of a lighting device depends generally of its intended use, type and requirements for mounting. For example the height can be between 1.5 cm-12 cm or between 4 and 35 cm.

The lighting devices can be of one or materials including e.g. steel, metal, rubber, plastic or glass. For example the main body can be of metal and the first and/or second thread is of rubber. In particularly, if the main body comprises a cooling element, the main body or at least the cooling part of it may be made of a metal, such as aluminium.

The materials can be chosen to satisfy e.g. safety, materials and/or cost issues.

Also asymmetric embodiments of the lighting device exists which for example can be used for soft illumination of wall decorations, paintings etc.

The invention also relates to an insertion arranged to engage the second thread of a lighting device. Such an insertion may provide various features to a lighting device according to the invention.

For example the insertion can be a protective cover used to avoid contact with the light source inside the lighting device or e.g. prevent dust and the like to enter the lighting device. The insertion can also be a frame masking of at least a part of the light source.

The insertion can be an ornament which may be either solely decorative or alternatively provide a defined feature e.g. a specific tint to the light or filter a specific wave length of the light from the lighting device enabling a lighting device to be used l various situations. Thus depending on the insertion the lighting device can for example be optimal for both work spaces requiring strong light and a bedroom needing night light and/or a softer omni light provided by a light diffuser.

The insertion may also comprise a plug or other type of power connection.

In some embodiments the insertion is a "tilting element" allowing that the direction of light from the lighting source is changeable. Such a tilting element can have different embodiments wherein the light source is kept in or by the tilting element and thus can be tilted and/or rotated to achieve a specific angel of the light cone from the light source. The tilting element may be comprised of an inner tilting element and an inner element connected in a way that provides for the tilting mechanism.

If the insertion is arranged to retain a light source in the lighting device a simple and effective way of holding the light source in the lighting device can be achieved. Using an insertion for retaining e.g. a LED bulb in the lighting device makes it possible to avoid the known system of using spring forced clips and instead keeping the bulb in place by simply allowing it to rest against the retainer. The retainer may have different embodiments but for example the retainer can provide a circumferential shoulder or a number of protrusions on which the bulb rests.

In some embodiments more than one insertion can be used e.g. to provide additional stabilisation to the light source. For example if the light source is an LED chip, an insertion may prevent the LED chip from tilting by keeping the chip in the centre.

The present invention further relates to a receiving element preferably comprising Means for attaching said receiving element in a building structure Means for receiving a lighting device as described herein.

Such a receiving element can advantageously be used if e.g. the lighting device is to be inserted into a building part which on its own does not provide enough stability or a sufficient grip between building part and lighting device.

Preferably the means of the insertion for receiving the lighting device is a threaded receiving part corresponding to the first thread of the lighting device which provides a connection between receiving element and lighting device which is reversible so that a lighting device and be mounted and remounted more than once if required.

For example the receiving element is at least in part a hollow cylinder wherein the lighting device is received in the hollow of said hollow cylinder whereby a simple and cost efficient receiving element can be provided.

The receiving element can be provided with means for fastening into a building structure. Such means can be different type of grips, collars, threads and the like. For example the receiving element can have a rubber collar along at least one of the ends ensuring a secured fit preventing that the receiving element unintentionally is pulled or pushed out of the hole in the building element into which the receiving element is inserted. A receiving element can also be a metal cylinder with a thread on the inside for receiving a lighting device according to the present invention and further having a number of slits extending from one end and along the longitudinal direction of the cylinder. These slits allow segments of the receiving element to be pushed outwards after the receiving element has been inserted into the hole, thereby fastening the receiving element. The segments may comprise protrusions, pins or the like which can catch the surface of the building element and thus secure that the receiving element does not rotate as the lighting device is inserted.

In several embodiments the receiving element is arranged for one or more lighting devices. Depending on shape and size of the receiving element said receiving element can be arranged to receive one or more lighting devices in configurations chosen based on form and/or function.

The receiving element can be made of rubber, plastic, wood, foam and/or metal depending on its intended use. For example a rubber receiving elements may be pressed into a new or existing hole and the first thread of a lighting device may engage in the rubber material to make a secure but easily obtained connection between receiving element and lighting device.

Lighting devices according to the present invention can be fitted in a building part by various methods depending on armature design and material of the building part.

For example lighting devices with a substantially cylindrical main body wherein the light bulb is received can advantageously be fitted into soft type loft panels by using the first thread on the outer surface to engage with a nut (indirectly securing via first thread). Here the lighting device is inserted into a matching hole in the building part e.g. loft panel. If the lighting device has a circumferential shoulder the lighting device is inserted so that the circumferential shoulder abuts the loft panel from one side of the panel and a part containing a part of the first thread of the lighting device protrude from the hole on the other side of the panel. A nut is then screwed onto the first thread of the protruding part thereby securing the lighting device in the loft panel.

For example lighting devices with a substantially cylindrical main body wherein the light bulb is received can advantageously be fitted into building parts such as hard type loft panels by using the first thread on the outer surface to engage with either the building part (directly securing via first thread) or via a receiving element (indirectly securing via first thread). I.e. in building parts which on its own can hold a lighting device according to the present invention, a lighting device can simply be attached by screwing the lighting device into a matching hole in the building part.

If a receiving element is used it can be an advantage if the hole is adapted to retain the receiving element in a way which allows a flush fit of building element and receiving element on at least one side of the receiving element.

Existing reflector type armatures can be refitted by a method either using existing small armatures or lighting devices of the present invention.

According to the refitting method an existing reflector type armature is provided and an opening for receiving a small armature is created in said reflector type armature. The small armature can be secured in the hole in the reflector type armature by means of clips e.g. when the small armature is of an existing type. Alternatively the small armature is a lighting device according to the present invention having an outer first thread which is used to secure the small armature by means of a nut.

In particularly the present invention provides for a modular lighting device wherein a main body may be combined with one or more of the other modules depending on the requirements to the lighting device.

The modular lighting device according to the invention may comprise one or more of the parts described above connected to form a suitable lighting device for a specific purpose and location in a building.

In one embodiment the lighting device comprises a main body, at least one receiving element, and a reflector. This embodiment is particularly relevant when the main body comprises a cooling element for cooling a light source in the form of a LED chip.

In another embodiment the lighting device comprises a main body, at least one receiving element, a reflector as well as at least one insertion as defined above. Accordingly, the lighting device may comprise an insertion for retaining the light source, and another insertion providing a tilting mechanism.

The modular lighting device also provides for different spot designs, such as a spot design comprising a main body having a cooling element, a reflector and a lamp element connected thereto, and the main body further being connected to a top and bottom element through a tilting element, and a spot design comprising a cylindrical main body secured through two nuts and further having a reflector and a cover plate.

Either of these lighting devices may comprise a lamp element in addition to the other elements. The lamp element may be the main body secured through the receiving element to the building structure. In such embodiment the lighting device may comprise a further main body for engaging with other elements, such as insertions, and/or for providing a cooling element.

Accordingly, the present invention provides a modular lighting device capable of being mounted in a much easier way than prior lighting devices, and furthermore capable of providing a variation of lighting devices through the combination of the various parts described herein. Thereby, the present invention has provided lighting devices for most purposes in offices, shops, airports and other buildings where multiple lighting devices are built into the walls or ceilings of the buildings.

DESCRIPTION OF THE DRAWINGS

The invention will in the following be described in greater detail with reference to the accompanying drawings. The drawings are provided as exemplary embodiments and are not to be construed as limiting to the invention.

DETAILED DESCRIPTION OF THE INVENTION

Figure 1:
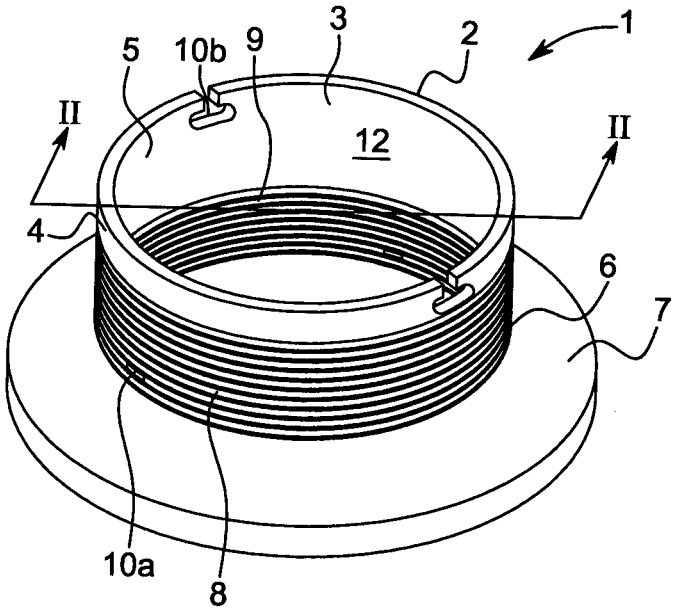
FIG. 1 shows a mainly cylindrical lighting device according to the present invention.

FIG. 1 shows a lighting device 1 comprising a cylindrical main body 2 having an outer surface 4 and an inner surface 3. The cylindrical main body 2 of the lighting device 1 has a first open end 5 opposing a second open end 6. Along the edge of the second open end 6 is a circumferential shoulder 7 along the outer surface 3. This shoulder provides a cover for the edges of the hole in the building structure into which the lighting source is inserted. On the majority of the outer surface is a first thread 8.

Along a section of the inner surface is a second thread 9.

The main body also comprises two through going holes 10*a* arranged to engage with a conventional retainer to keep e.g. a halogen light bulb in place in the lighting device and holes 10*b* for mounting traditional clips if desired. However both 10*a* and 10*b* are optional.

Figure 2:
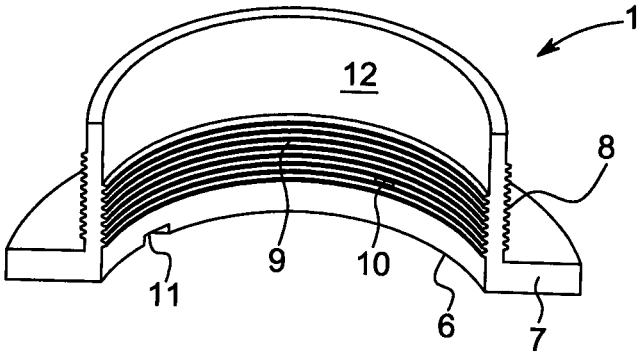
FIG. 2 shows a cross section of the lighting device of FIG. 1 taken along the line II-II.

FIG. 2 shows a sectional view of FIG. 1 taken along the line II-II.

In this view is also seen an indent 11 in the edge/shoulder of the second open end 6 of the main body. This indent can be used to engage with a specially developed tool for mounting and releasing the lighting device.

In both FIGS. 1 and 2 the inner surface defines a receiving section 12 wherein a light source (not shown), such as a LED bulb, can be received.

Figure 3:
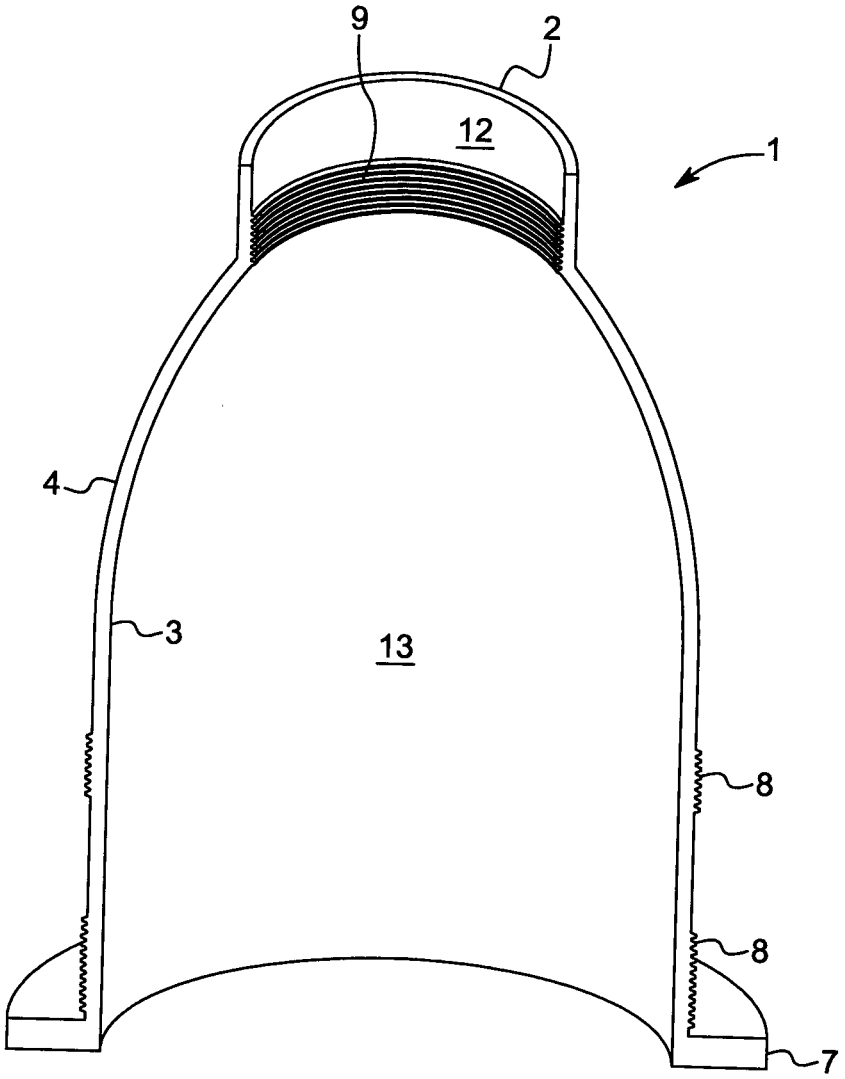
FIG. 3 shows a cross section of a reflector type lighting device according to the present invention.

FIG. 3 shows a lighting device 1 wherein the inner surface forms receiving section 12 for receiving a light source and another section 13 forming a reflector. I.e. this embodiment is a reflector type lighting device.

For illustrative purposes the outer surface is shown with two different first threads both arranged to allow the fastening of the lighting device in e.g. e loft panel. Depending on the intended use of the lighting device the outer surface may comprise one or more first threads.

Figure 4:
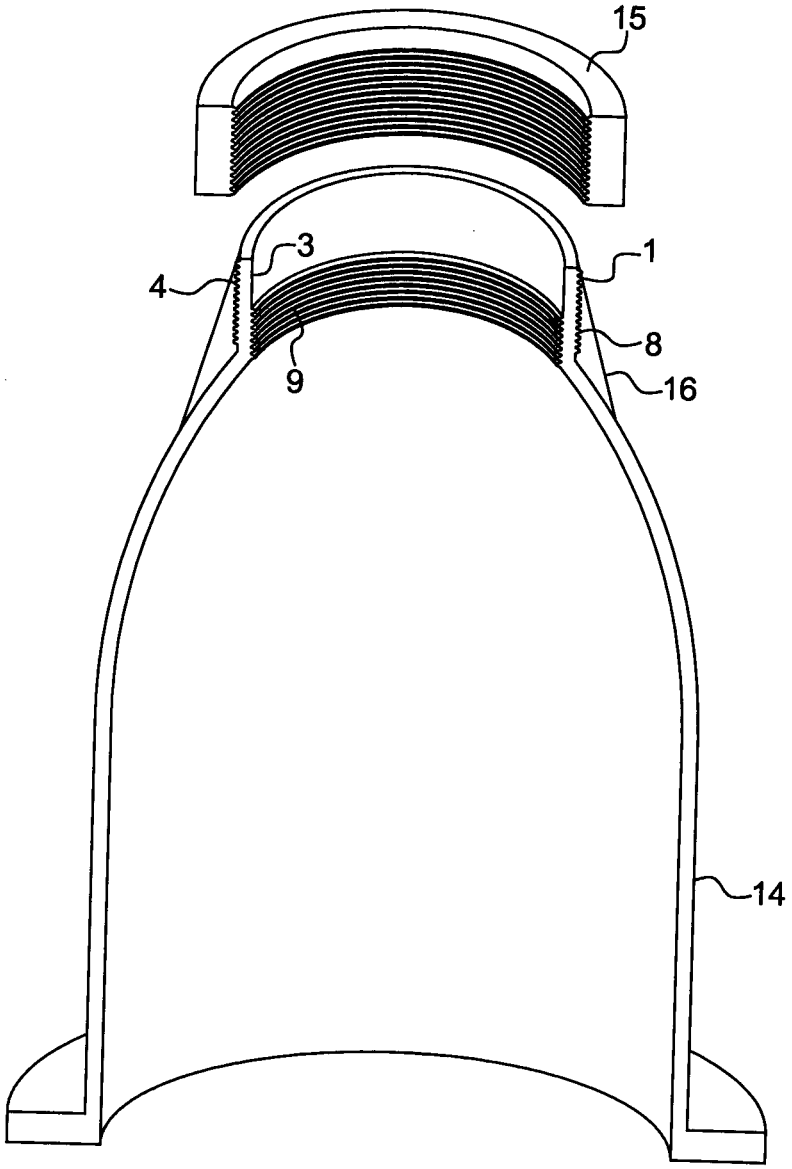
FIG. 4 illustrates a refitting method.

FIG. 4 shows a lighting device 1 according to the present invention used to refit an existing reflector 14.

Here the apex part of the existing reflector has been removed and a lighting device 1 according to the present has been inserted in the created hole in the apex. The lighting device 1 can for example be secured in its position via a nut arranged to engage the first thread of the lighting device. Alternatively the lighting device can be secured via traditional clips 16 used for mounting e.g. halogen fittings in loft panels—the latter option can also be used to refit existing reflectors with existing small armatures.

Existing reflector type armatures can be refitted by a method either using existing small armatures or lighting devices of the present invention.

According to the method an existing reflector type armature is provided and an opening for receiving a small armature is created in said reflector type armature. The small armature can be secured in the hole in the reflector type armature by means of clips e.g. when the small armature is of an existing type. Alternatively the small armature is an armature according to the present invention having an outer first thread which can engage with a nut 15 and thereby fasten the small armature to the reflector.

Figure 5:
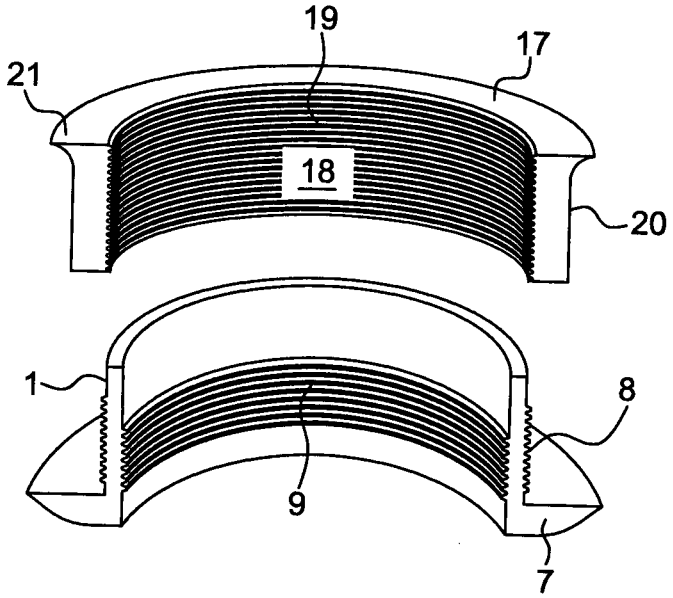
FIG. 5 shows a cross section of a first embodiment of a receiving element.

FIG. 5 shows a receiving element 17 for receiving a lighting device 1 according to the present invention in means for receiving a light source in form of hollow 18. The receiving element 17 in this embodiment is a mainly cylindrical body with receiving means in form of a thread 19. The thread 19 is arranged to engage with the first thread 8 of a lighting device 1. The outer side 20 of the receiving element 17 is in the present embodiment smooth but may be arranged with various means for inserting in a building structure. The receiving element has a circumferential collar 21 which may be used to secure or stabilize the receiving when it is inserted in a building element or part.

Figure 6:
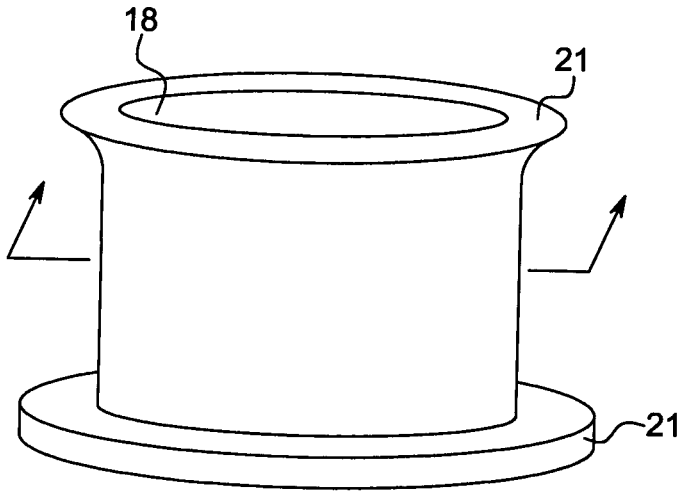
FIG. 6 shows a second embodiment o a receiving element.

FIG. 6 shows a receiving element 17 with a mainly cylindrical shape similar to what is shown in FIG. 5. In this embodiment the receiving element 17 also has a circumferential collar 21 at both ends.

Figure 7A:
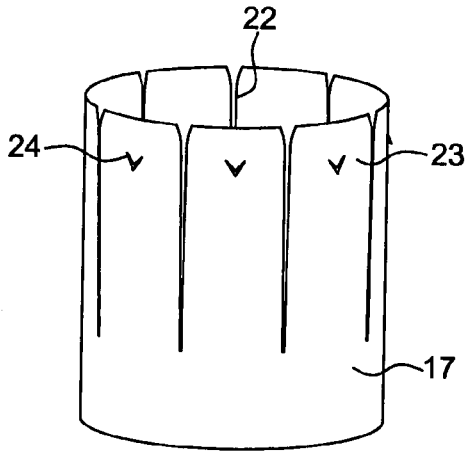
FIGS. 7*a* and 7*b* shows a third embodiment of a receiving element.

FIG. 7*a* shows another embodiment of a receiving element 17 having a number of longitudinal slits 22 thus defining a number of segments 23 each having a hook 24.

Figure 7B:
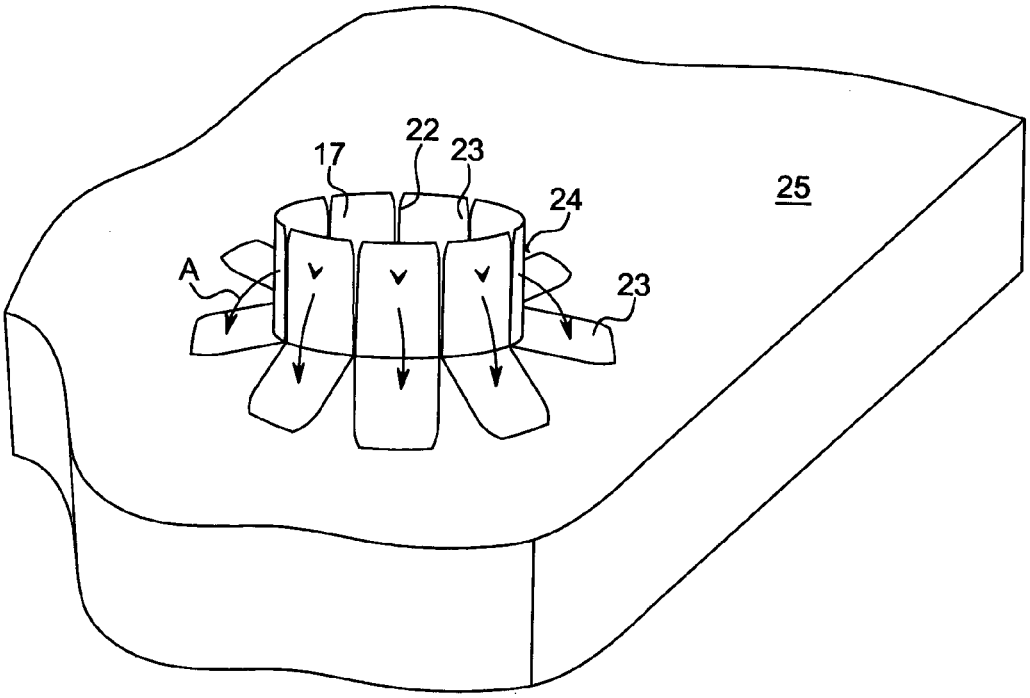

FIG. 7*b* shows the receiving element 17 from FIG. 7*a* mounted in a board 25. The function of the segments 23 is illustrated by the arrows A indicating how each segments can be bend outwards allowing the hooks 24 to engage with the surface of the board 25 thereby securing the receiving element further to the board.

Figure 8A:
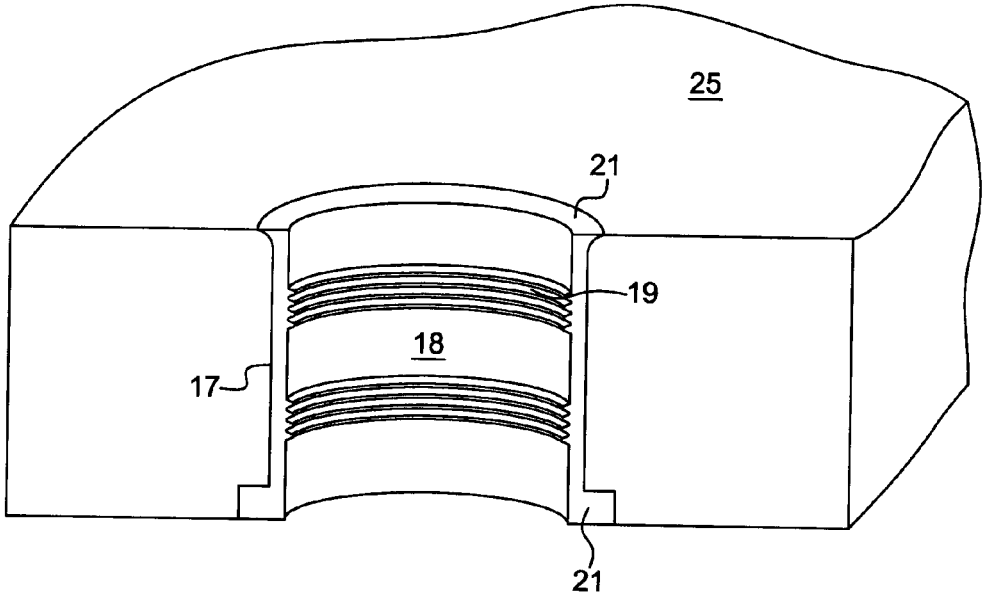
FIGS. 8*a* and 8*b* shows the receiving element from FIG. 6 inserted in a building element together with a special tool.
Figure 8B:
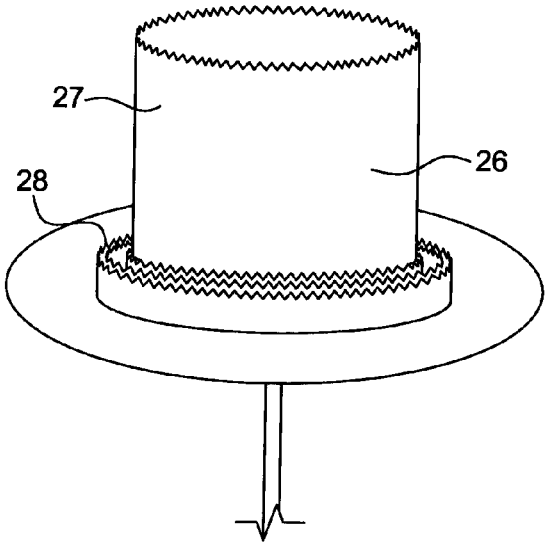

FIG. 8*a* shows a cross section of the receiving element 17 from FIG. 6 engaged in a building element 25. FIG. 8*b* shows a special tool for drilling special holes for the receiving elements 17. The tool comprises a main cylinder 27 for drilling the main part of the hole and a rasp like section 28 for making the recession in which the collar 21 can be contained.

Figure 9:
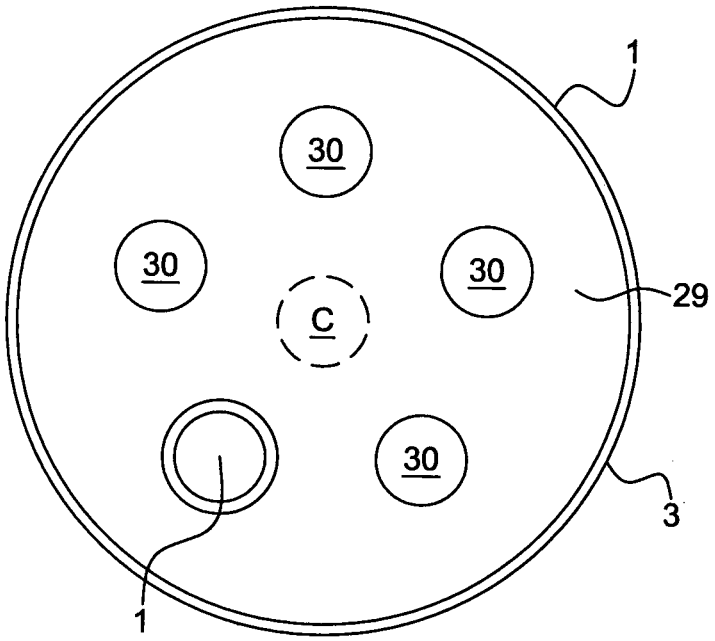
FIG. 9 shows an insertion arranged to receive three lighting devices

FIG. 9 shows an insertion 29 with three means 30 for receiving a lighting device, i.e. three circular holes with threads for engaging in first threads 8 of a lighting device 1. The insertion 29 is in the present example inserted in a large lighting device 1 with a circular cross section.

If the insertion 29 is inserted directly into a building element the insertion can be regarded as a receiving element 17 for holding more than one lighting device 1.

In some embodiments the insertion 29, or other type of insertions, may further comprise ventilation, speaker, alarm system etc. as indicated in the centre C by a dotted circle.

Figure 10A:
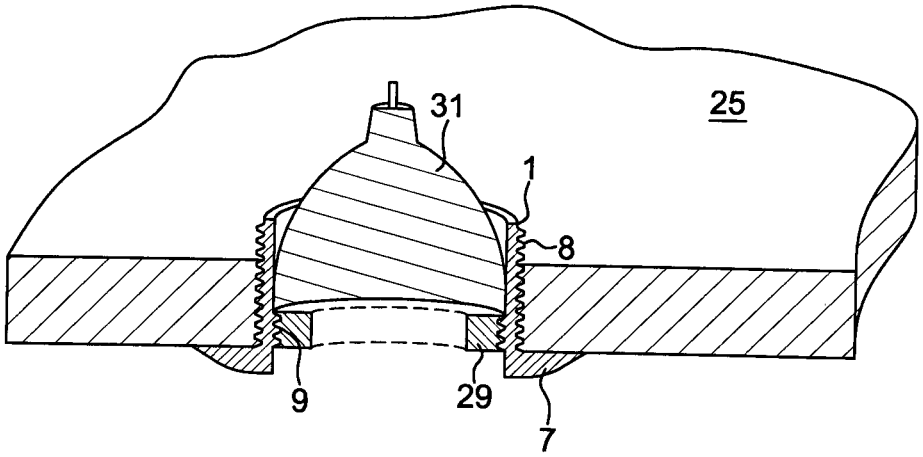
FIGS. 10*a* and 10*b* show a light source in a lighting device inserted into a building element

FIG. 10*a* shows a sectional view of a lighting device 1 with an insertion 29 engaged in the second thread 9. The insertion 29 this way forms a circumferential shoulder of the inner surface, which shoulder is used to retain a light source 31 in the lighting device 1. FIG. 10 also shows how lighting devices 1 can be inserted into e.g. a loft panel, wall structure etc. 25 by means of the first thread 8.

Figure 10B:
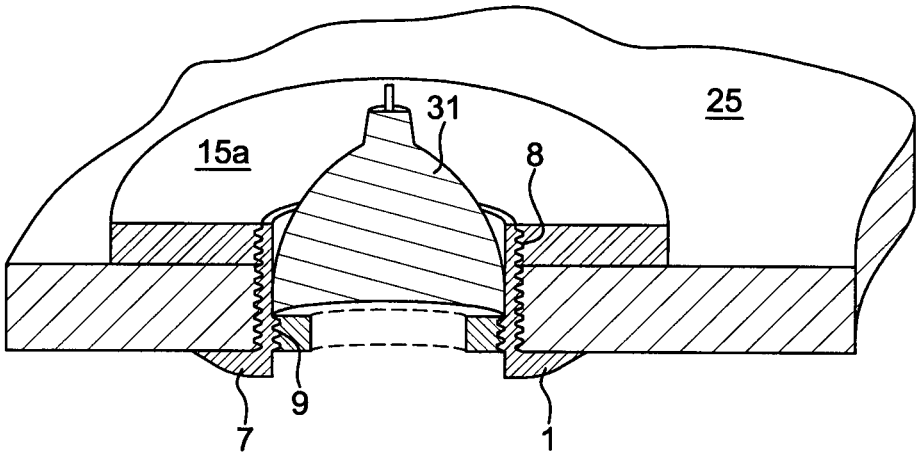

FIG. 10*b* shows a lighting device 1 mounted in a building element by means of a plate-like nut 15*a* engaging the first thread 8.

Figure 11:
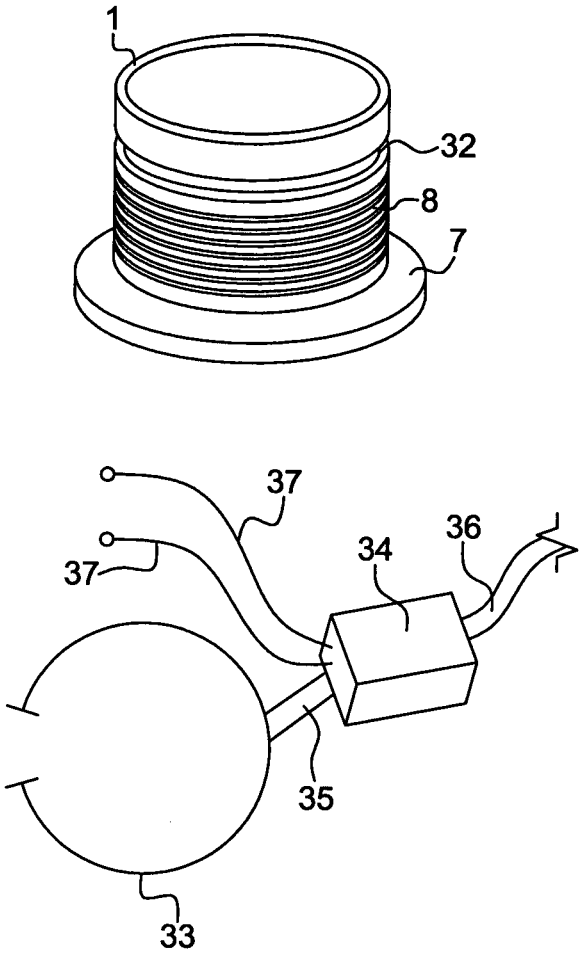
FIG. 11 shows a lighting device with first and second attachment means FIGS. 12*a* and 12 *b* show special tools for mounting and releasing lighting devices according to the present invention.

FIG. 11 shows a lighting device 1 with attachment means 32, 33 for movably fastening a control unit 34 to via a holder 35. In this example the attachment means is a circumferential recess 32 in the outer surface and a clip 24 arranged to grip around the lighting device in the recess 32. The unit control is attached to a main cable 36 and two cables 37 for connecting to a fitting. Other elements such as a transformation can be movably attached in a similar way.

This way the attachment means allows the control unit, or other device 34 to rotate with respect to the lighting device 1 a feature which can be highly relevant when the lighting device is mounted in the building part via the first thread.

Figure 12A:
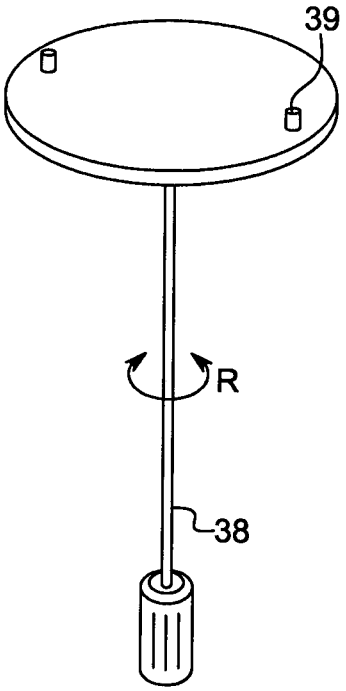
Figure 12B:
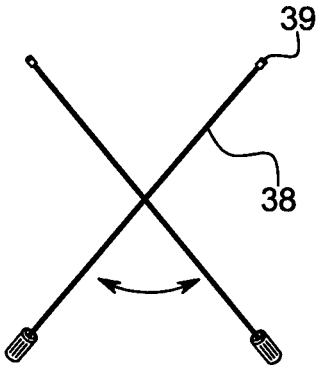

FIGS. 12*a* and 12*b* show two different embodiments of a special tool 38 for inserting and releasing a lighting device according the present invention. The tool comprises means for engaging with the indents 11 of a lighting device.

Figure 13A:
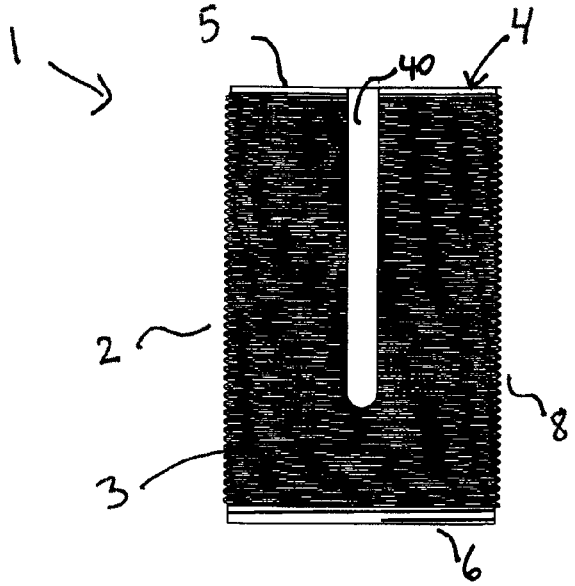
FIGS. 13*a*, 13*b*, and 13*c* show different views of a mainly cylindrical main body according to the present invention.

FIG. 13*a* shows a lighting device 1 comprising a cylindrical main body 2 having an outer surface 3 and an inner surface 4. The cylindrical main body 2 of the lighting device 1 has a first open end 5 opposing a second open end 6. A slit 40 is shown from the first open end extending more than half of the length of the main body 2. On the majority of the outer surface is a first thread 8. The slit 40 is provided to allow a cable into the main body 2 towards a light source positioned within the main body 2.

Figure 13B:
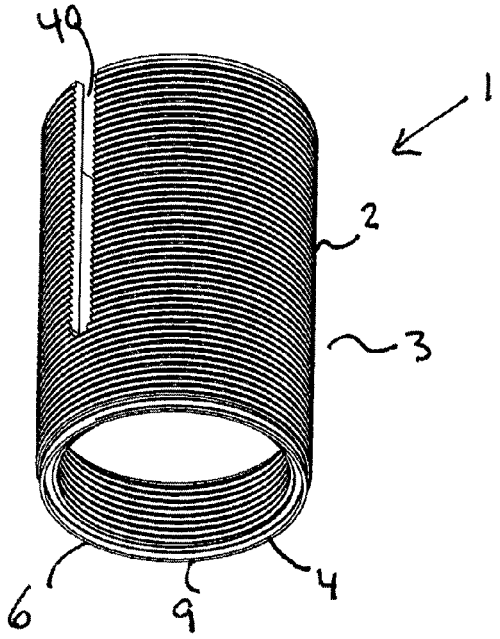

FIG. 13*b* shows the same main body 2 seen from below. Along a section of the inner surface is a second thread 9.

Figure 13C:
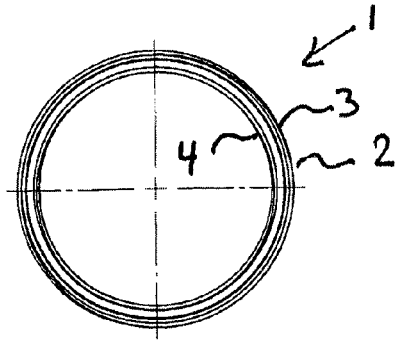

FIG. 13*c* shows a cross-section of the main body 2 in FIG. 13*a*.

Figure 14A:
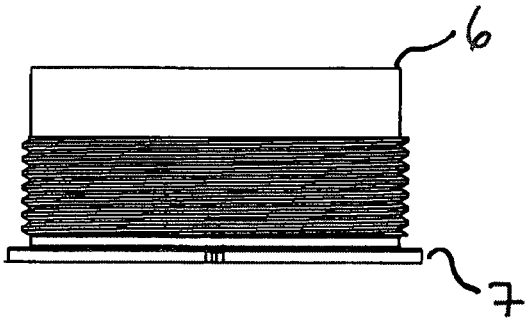
FIGS. 14*a* and 14*b* show an insertion element.
Figure 14B:
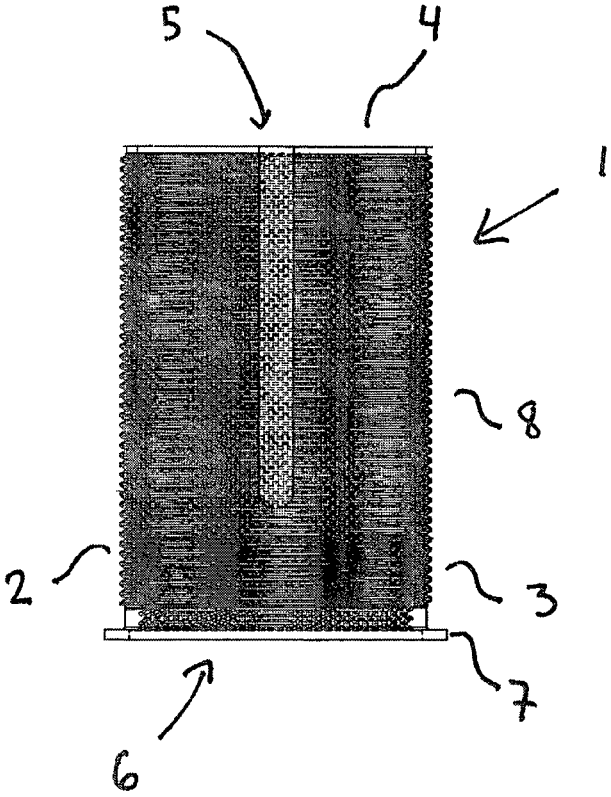
Figure 15A:
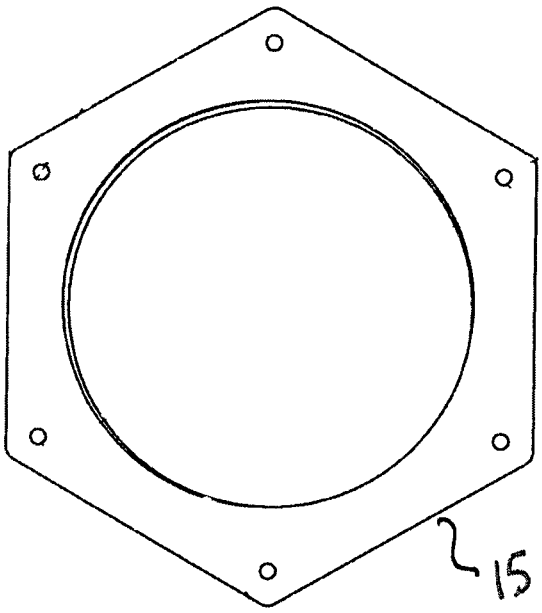
FIGS. 15*a* and 15*b* show a nut
Figure 15B:
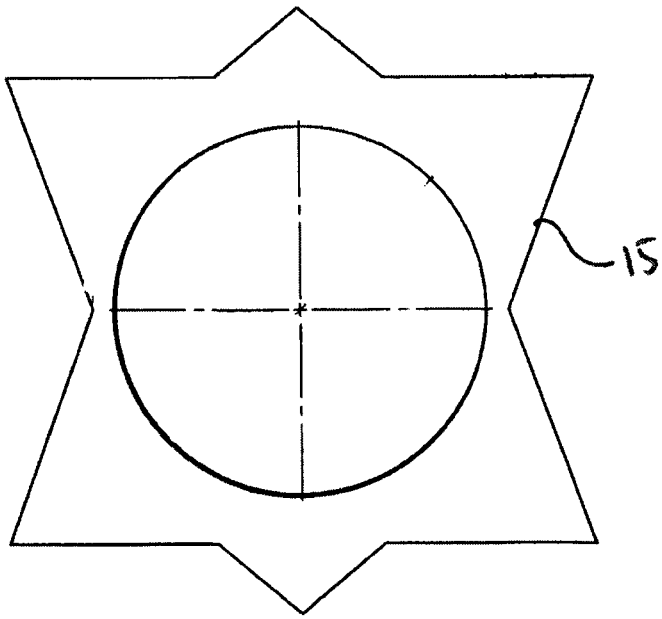
Figure 17:
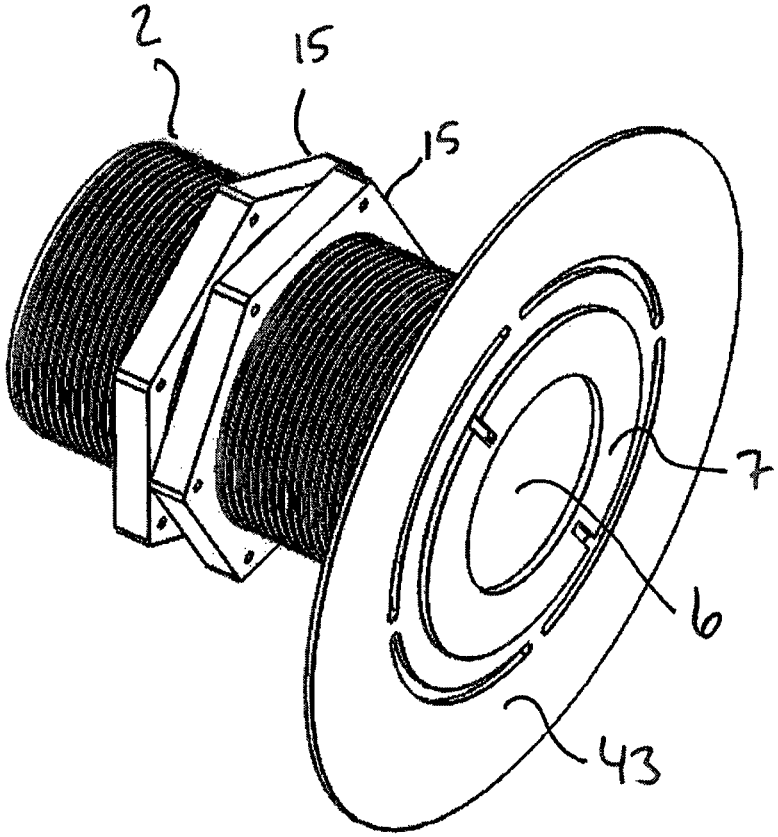
FIG. 17 shows an assembled lighting device comprising main body, two nuts, insertion element and cover plate

FIG. 14*a* shows an insertion element 6 to be inserted into the main body 2. The insertion element 6 has a shoulder 7 for covering edges of the hole in the building structure, and FIG. 14*b* shows the insertion element 6 of FIG. 14*a* positioned in the main body 2. When the insertion element 6 is positioned in the main body 2 it may also provide a seat for the light source, in particularly when the light source is an LED chip that may rest on the circumference of the insertion element 6:

FIGS. 15*a* and 15*b* shows a receiving element in the form of a nut 15 for securing a main body 2 in the building structure. In some embodiments one nut 15 is enough to secure the main body 2. However, it may be preferred, as seen in FIG. 17 to provide at least two nuts 15, for example for attaching a cable attachment or for securing the main body 2 on both sides of the building structure. In the drawings the nut 15 is shown as a hexagonal nut or a star-formed nut, however the nut may have any other suitable shape capable of performing the function, such as a square, or triangle.

Figure 16A:
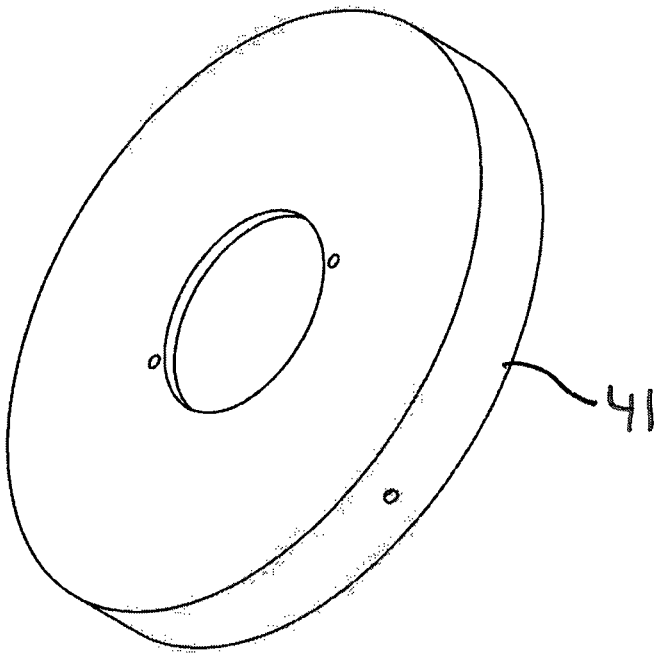
FIGS. 16*a* and 16*b* show a top part and a bottom part for the main body
Figure 16B:
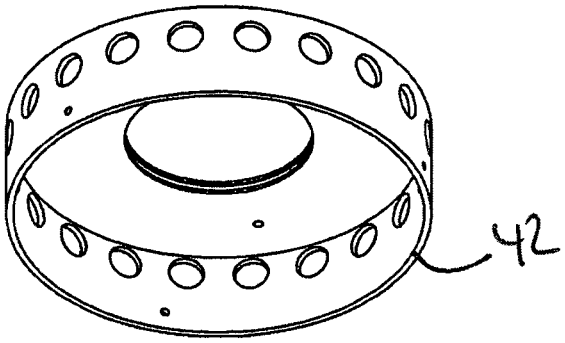

FIG. 16*a* shows a top 41 for example for closing the upper part of the main body. The top 41 is shown with a hole allowing any heat to disappear, however the top may have any suitable form. FIG. 16*b* shows a bottom 42 that may be used with top 41, for example for housing cables and/or drivers for the light source.

FIG. 17 shows the modular lighting device comprising a main body 2, two nuts 15, an insertion element 6 with its shoulder 7 as well as a cover plate 43 assembled into the modular lighting device. The cover plate 43 may be used for decorative purposes as well as for covering any holes in the existing building structure.

Figure 18:
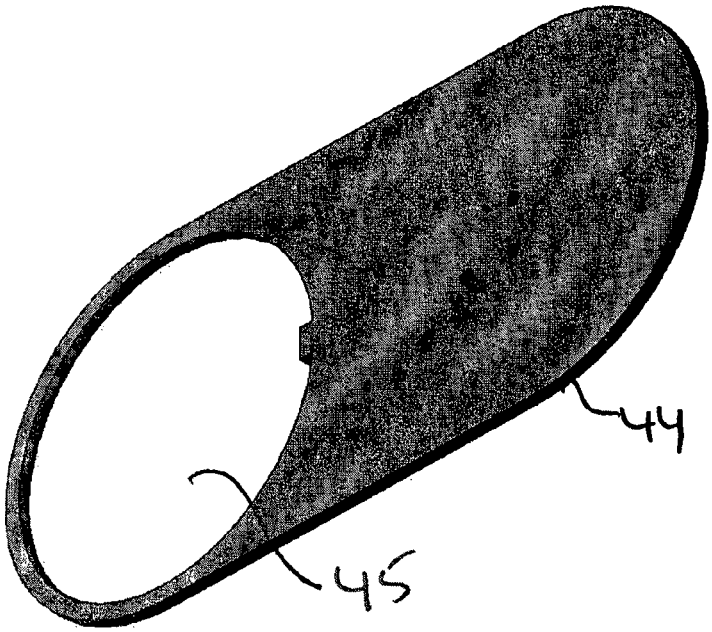
FIG. 18 shows a plate for attaching a connector

FIG. 18 shows an attachment plate 44 capable of holding connector and/or cable for the lighting device. The plate 44 may be attached to the main body 2 by any suitable means, such as by sliding it over the main body 2 or by screwing it onto the main body. In the present embodiment the plate 44 has a circular hole 45 in one end, said hole being adapted to fit over the main body 2. The plate 44 may be secured to the main body 2 through the use of one or more nuts 15 as shown in FIG. 15. When the connector and/or the cable is attached to the main body 2 then it is easy to install and repair both, since the cable and connector is arranged together with the main body 2.

Figure 19:
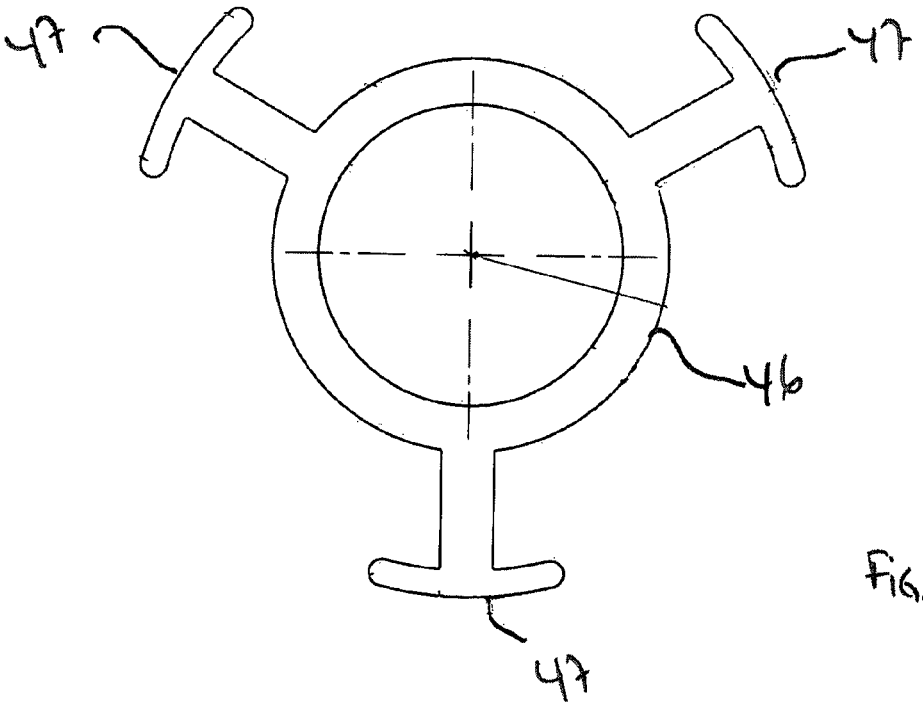
FIG. 19 shows a stabilising insertion element for stabilising an LED chip or the like FIG. 20*a* shows a main body in the form of a cylinder comprising fins extending radially functioning also as a cooling element.

FIG. 19 shows an insertion stabiliser 46 for stabilising a light source within a main body 2. The shown insertion stabiliser 46 is especially suited for stabilising an LED chip, such as a GUI LED chip. The extending parts 47 may for example rest against the inner surface of the main body 2 when in use, and heat may pass from the LED chip through the holes in the insertion stabiliser 46.

Figure 20A:
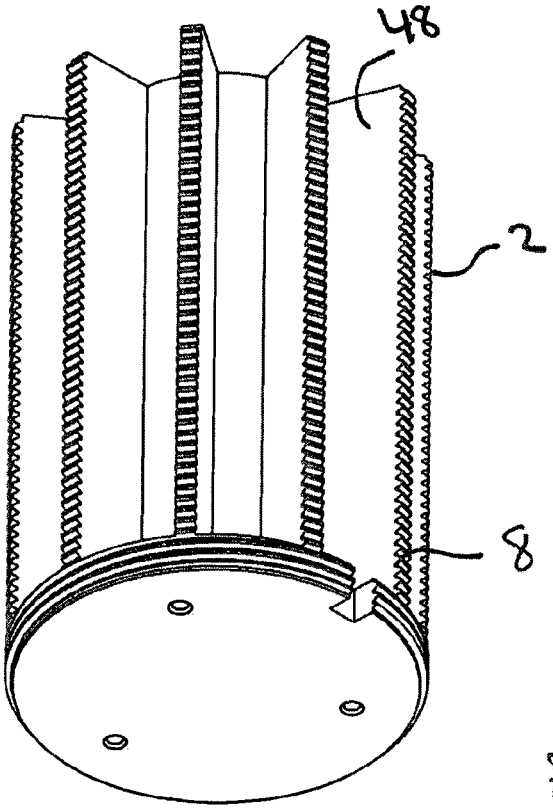
FIG. 20*b* shows a reflector.
Figure 20B:
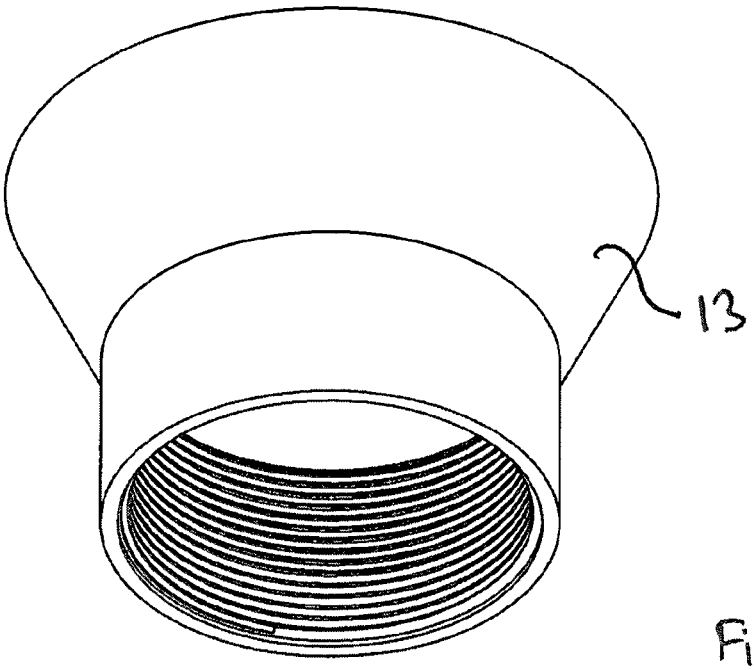

FIG. 20*a* shows another embodiment of a main body 2 comprising fins 48 extending radially functioning also as a cooling element. On the outer surface of the fins 48 is a first thread 8. This type of main body 2 is particularly suited for light sources emitting substantial amounts of heat. Such as light source may be attached to the main body 2, for example screwed to the main body 2. The main body may be used in any of the modular lighting devices discussed herein, such as replacing the cylindrical main body 2 of FIG. 1 and FIG. 13. In particularly, the main body 2 with fins 48 may be used in a lighting device as shown in FIG. 20*b* wherein a reflector 13 is attached to the main body 2. The reflector 13 may be screwed onto or into the main body 2, or it may be made as an integrated part of the main body 2.

Figure 21A:
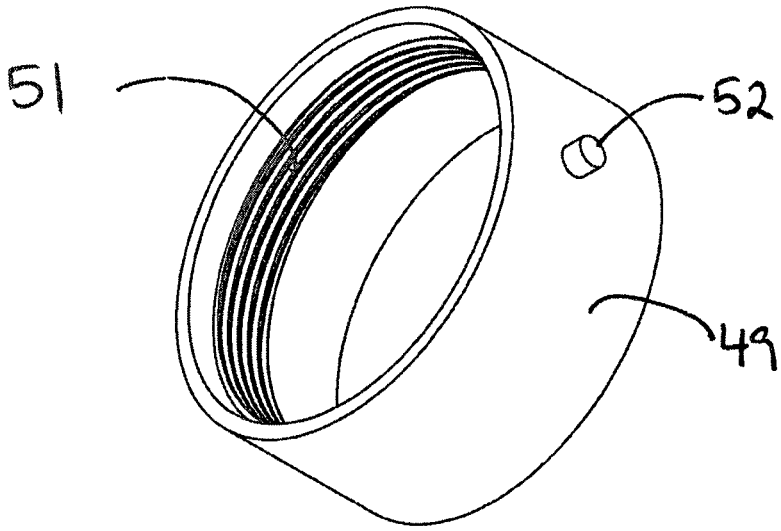
FIGS. 21*a* and 21*b* shows a tilting element comprising inner tilting part and inner part
Figure 21B:
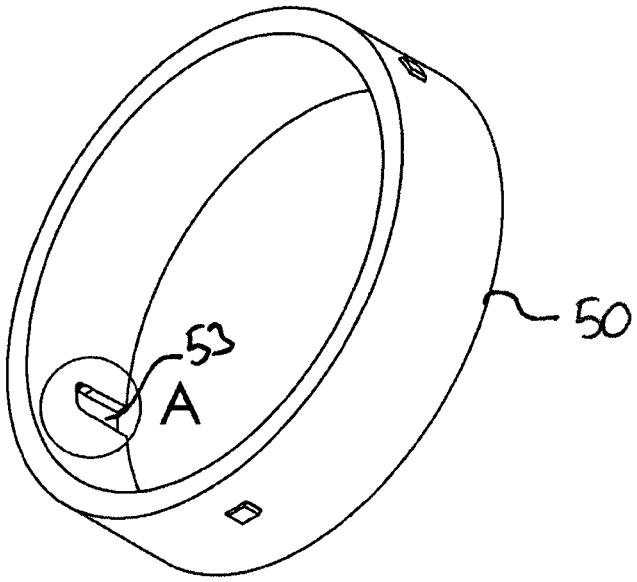

FIG. 21*a* shows an inner tilting element 49 to engage the inner element 50 in FIG. 21*b* thereby forming a tilting element. The inner tilting element 49 may be attached to the main body 2 through inner threads 51. The inner tilting element 49 is engaged with inner element 50 through protrusions 52 into recesses 53 thereby forming a tilting element that allows for changing the direction of light from the light source.

Figure 22A:
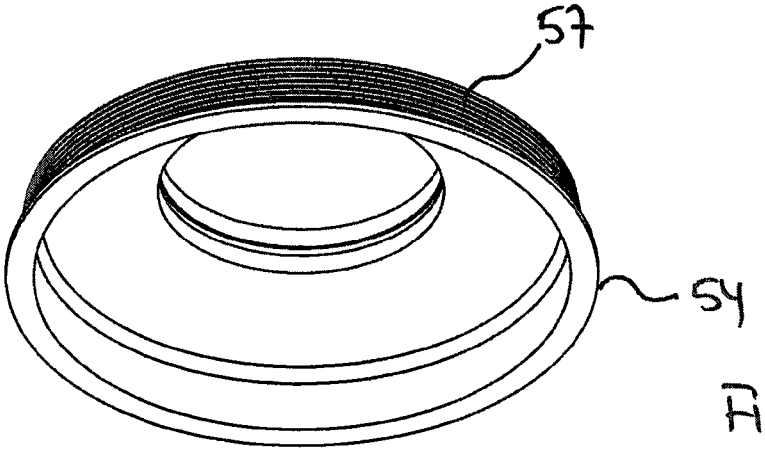
FIG. 22 shows another main body in the form of a lamp part
Figure 22B:
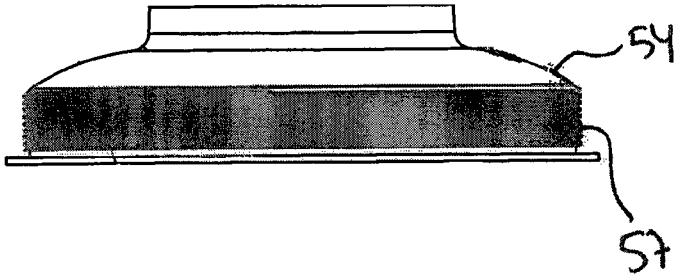

FIG. 22*a* shows a lamp element 54 that may be used as a main body 2 on its own or attached to a main body 2. When being used on its own the lamp element 54 may be secured to the building structure through the use of for example nuts 15 as discussed herein. FIG. 22*b* shows the lamp element 54 more clearly showing the threads 55 for allowing the lamp element 54 to be received into a receiving element as described herein.

Figure 23A:
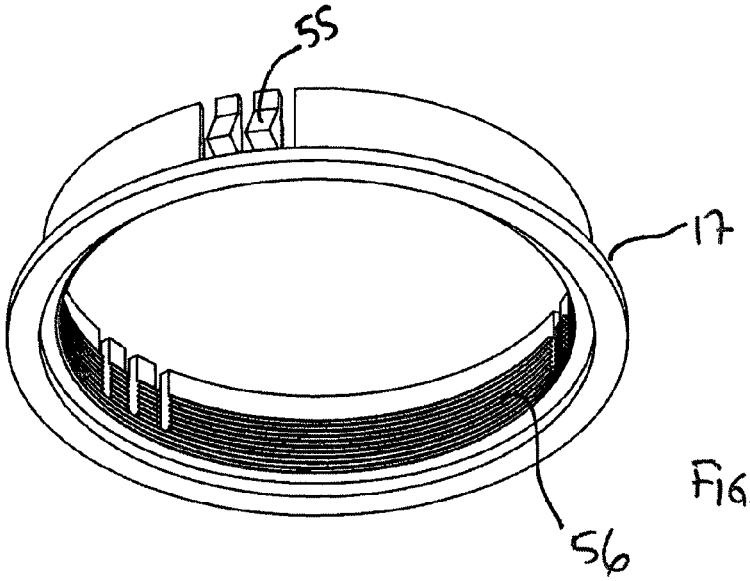
FIGS. 23*a* and 23*b* show two different forms of receiving elements.
Figure 23B:
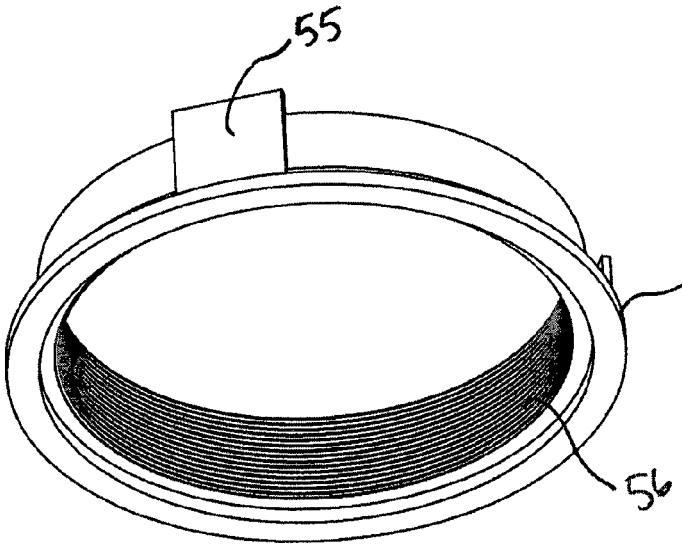

FIG. 23*a* and FIG. 23*b* show two different receiving elements 17 having protrusions 55 for engaging the building structure into which the lighting device 1 is to be inserted. The receiving elements 17 comprises a thread 56 on the inner surface. The receiving elements 17 may be used as an alternative to the nuts described above. However, the receiving elements 17 may also be used in connection with the nuts described above, for example when the nut is used for securing attachment means for the cable and/or the connector.

Figure 24:
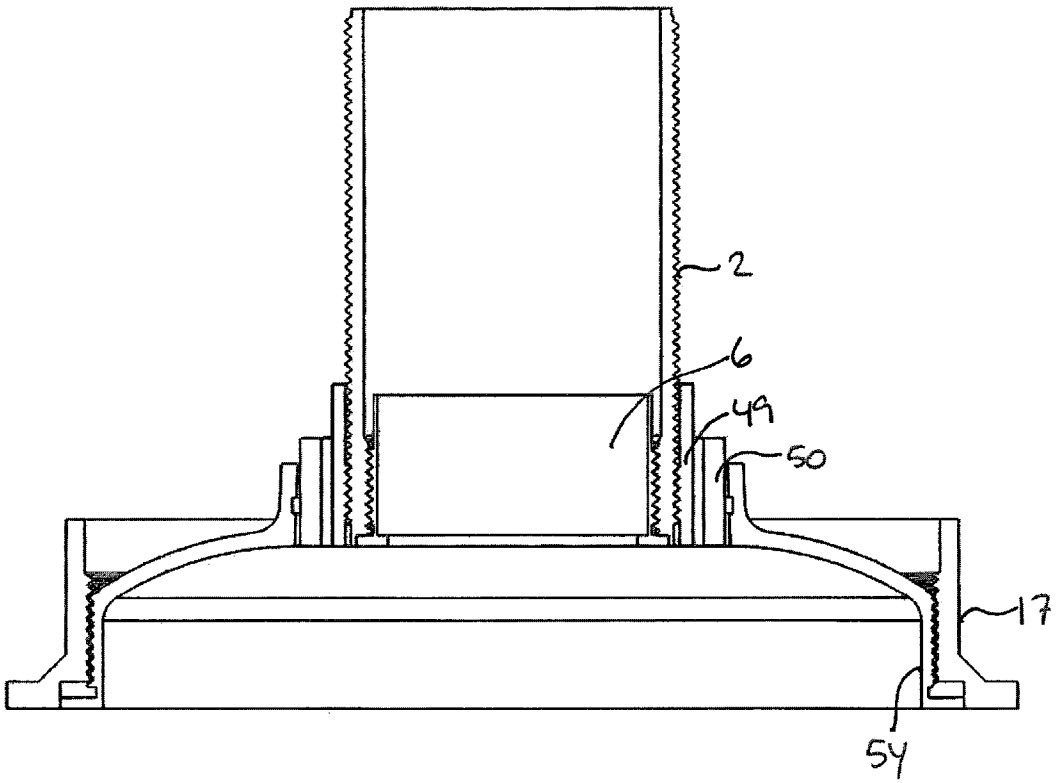
FIG. 24 shows an assembled lighting device according to the invention

FIG. 24 shows an assembled modular lighting device according to the invention comprising receiving element 17 for receiving a lamp element 54 and further comprising a tilting inner element 49 and an inner element 50 for tilting the cylindrical main body 2 housing the light source. Furthermore, an insertion 6 is positioned inside the main body 2 for providing a retaining position for the light source on the upper part of the insertion 6.

Figure 25:
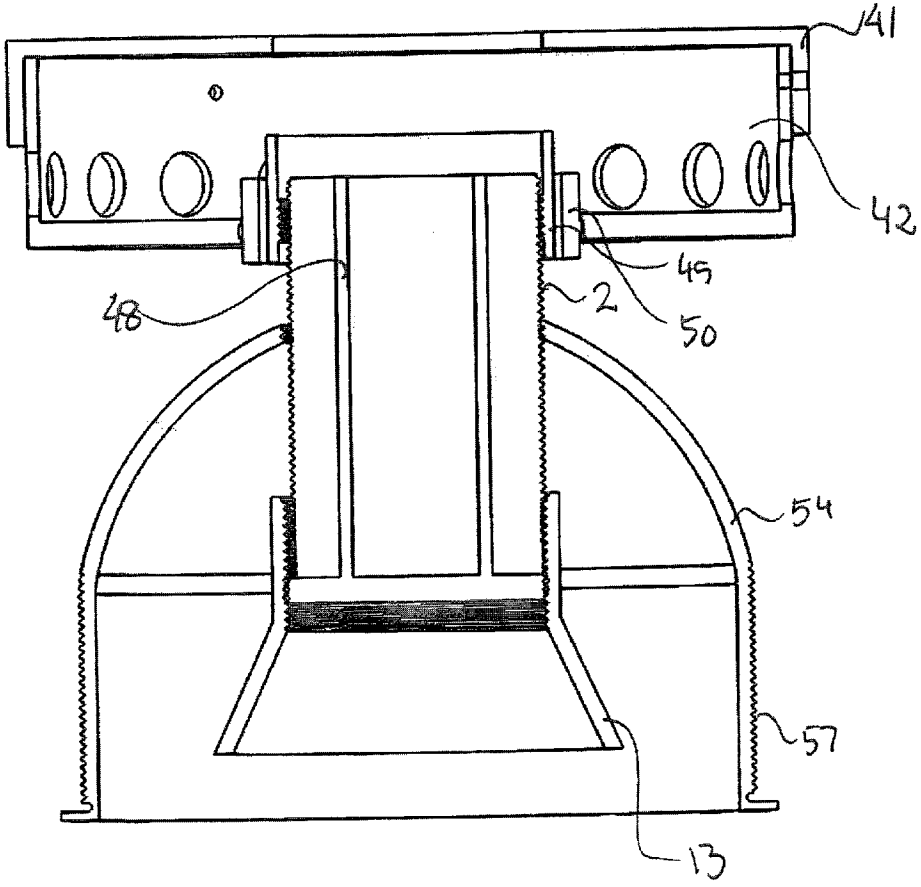
FIG. 25 shows an assembled lighting device having a spot design

FIG. 25 shows an assembled modular lighting device according to the invention wherein a main body 2 comprising a cooling element is connected to a reflector 13 and a lamp element 54 having external threads 57. To the other end of the main body 2 is connected a top and bottom element through a tilting element having an inner tilting element 49 and an inner element 50. The assembled modular lighting device may be used as a spot wherever tiltable spots are required.

Figure 26:
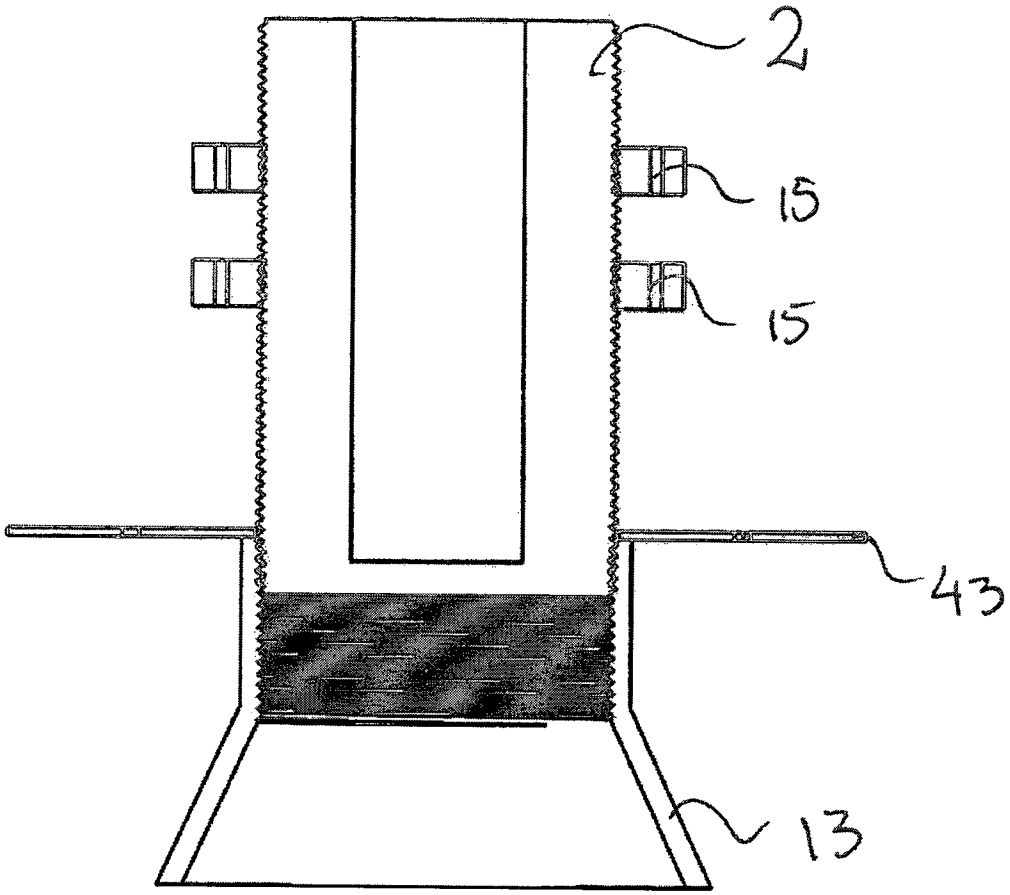
FIG. 26 shows an assembled lighting device having another spot design

FIG. 26 FIG. 25 shows an assembled modular lighting device according to the invention wherein a cylindrical main body 2 is connected to a reflector 13. A cover plate 43 is arranged above the reflector 13. Two nuts 15 are provided towards the other end of the main body 2 for securing the modular lighting device to a building part.

The invention claimed is:

1. A modular lighting device comprising:

a main body having a section for receiving a light source and an outer surface, wherein the outer surface has a first thread defined along an area of said outer surface for securing the lighting device in a building part through at least two receiving elements, at least two receiving elements for receiving said main body, said receiving elements each having a threaded receiving part corresponding to the first thread along the outer surface of the main body, and said at least two receiving elements are at least two nuts, and wherein said main body has an inner surface operable for fastening the light source and wherein said inner surface comprises a second thread defined along the inner surface for fastening the light source to the main body.

2. A lighting device according to claim 1, wherein said main body is a cylindrical element.

3. A lighting device according to claim 1, wherein said inner surface at least in part forms a reflector.

4. A lighting device according to claim 1, further comprising a reflector, wherein said reflector comprises a thread engageable with either the first or the second thread of the main body.

5. A lighting device according to claim 1 comprising attachment means for attaching a control unit for the light source.

6. A lighting device according to claim 5, wherein said attachment means enables rotation of the control unit relative to the main body of the lighting device.

7. A lighting device according to claim 5, wherein said attachment means comprises a first part comprising a circumferential recess in the outer surface.

8. A lighting device according to claim 5, wherein said attachment means comprises a second part in the form of a clip for movably engaging said first attachment means.

9. A lighting device according to claim 5, wherein said attachment means is a plate attached to the main body.

10. A lighting device according to claim 1, further comprising an insertion disposed so as to engage said second thread of said main body.

11. A lighting device according to claim 10, wherein said insertion is a protective cover, frame, ornament and/or light diffuser.

12. A lighting device according to claim 10, wherein said insertion comprises a tilting element.

13. A lighting device according to claim 10, wherein said insertion is configured and operable so as to retain a light source in the lighting device.

14. A lighting device according to claim 1, wherein said receiving element is operable for attachment to a building structure.

15. A lighting device according to claim 14 wherein said receiving element is at least in part a hollow cylinder and wherein the lighting device is received in the hollow of said hollow cylinder.

16. A lighting device according to claim 14, wherein the receiving element is made of rubber, plastic, foam and/or metal.

17. A lighting device according to claim 1, wherein the lighting device comprises a main body, at least one receiving element, and a reflector.

18. A lighting device according to claim 1, wherein said main body is a cooling element having a plurality of fins extending radially and said first thread is provided at the outer surface of said fins.

19. A lighting device according to claim 1, wherein said main body comprises a first end and a slit extending from the first end.

* * * * *